US005782689A

United States Patent [19]

Woolsey et al.

[11] Patent Number: 5,782,689

[45] Date of Patent: Jul. 21, 1998

[54] FABRIC FACED AIR DISTRIBUTION DEVICE

[75] Inventors: Michael E. Woolsey, Oro Valley; G. Michael Kaler, Jr.; Gordon G. Jones, both of Tucson, all of Ariz.

[73] Assignee: Tomkins Industries Inc., Dayton, Ohio

[21] Appl. No.: 584,087

[22] Filed: Jan. 11, 1996

[51] Int. Cl.[6] ..... F24F 13/075

[52] U.S. Cl. ..... 454/296; 454/297

[58] Field of Search ..... 454/296, 297, 454/298

[56] References Cited

U.S. PATENT DOCUMENTS

| | | | |
|---|---|---|---|
| 1,701,149 | 2/1929 | Eha . | |
| 2,798,942 | 7/1957 | Mason . | |
| 2,886,697 | 5/1959 | Pomeroy . | |
| 4,009,647 | 3/1977 | Howorth | 454/187 |
| 4,023,472 | 5/1977 | Grunder et al. | 454/338 |
| 4,164,173 | 8/1979 | Douglas | 454/299 |
| 4,371,386 | 2/1983 | DeVecchi | 454/296 X |
| 4,446,506 | 5/1984 | Larson | 362/17 |
| 4,616,558 | 10/1986 | Ball et al. . | |
| 4,898,087 | 2/1990 | Fitzner et al. | 454/296 |
| 5,023,756 | 6/1991 | Regester | 362/16 |
| 5,529,844 | 6/1996 | Degen et al. | 428/357 |

FOREIGN PATENT DOCUMENTS

| | | | |
|---|---|---|---|
| 3-110342 | 5/1991 | Japan | 454/296 |

OTHER PUBLICATIONS

A.M. Zhivov, "*Variable-Air-Volume Ventilation Systems For Industrial Buildings*", pp. 367–372.

Chemfab Belts Brochure, Chemfab Corporation.

*Primary Examiner*—Harold Joyce

*Attorney, Agent, or Firm*—Calfee, Halter & Griswold LLP

[57] ABSTRACT

An induction diffuser (100), radial flow diffuser (130), linear diffuser (150) and supply or return grille (170) use a fabric face (102, 132, 152, 172) to form the exposed portion thereof. The fabric face is preferably made of fiberglass or Kevlar coated with teflon. The use of the fabric face increases reflectivity of incident light, reduces sound levels, provides a durable and easily cleanable surface and provides other significant benefits.

5 Claims, 9 Drawing Sheets

FABRIC FACED AIR DISTRIBUTION DEVICE

TECHNICAL FIELD OF THE INVENTION

This invention relates to the supply of air to an enclosed volume and the return of air therefrom to control the temperature and humidity within the volume.

BACKGROUND OF THE INVENTION

Conventional ceiling and wall air outlets and returns (air devices) either make no effort to mask the device from view, or mask the device using a perforated or expanded steel or aluminum faceplate. The metal faceplate may be fixed to the air device in such a manner as to be flush or nearly flush with the ceiling. This is typical in high induction diffusers, returns and laminar flow devices. The metal face can protrude downwardly from the ceiling plane into the occupied space. This is typical in forced displacement and radial flow type diffusers. Supply and return grilles can be either ceiling, floor, or wall mounted and typically have no face at all for masking purposes.

It is desirable to make the air devices as attractive as possible and to maintain an attractive appearance for as long as possible. Therefore, a need exists for improved techniques to achieve these purposes.

SUMMARY OF THE INVENTION

In accordance with one aspect of the present invention, an air circulation device is provided for conditioning a room. The air circulation device includes a frame defining a duct for non-laminar flow of air through the frame. The frame defines an opening into the room. A fabric is mounted to the frame covering the opening. In accordance with another aspect of the present invention, the fabric is teflon coated.

In accordance with another aspect of the present invention, the air circulation device can be an induction diffuser, a radial flow diffuser, a linear diffuser, or a supply grille. Any of these devices can serve to supply air to an enclosed volume, such as a room, or as return devices to remove air from the enclosed volume

BRIEF DESCRIPTION OF THE DRAWINGS

For a more complete understanding of the present invention and for further advantages thereof, reference is now made to the following detailed description taken in conjunction with the accompanying drawings, in which.

DETAILED DESCRIPTION

Figure 1:
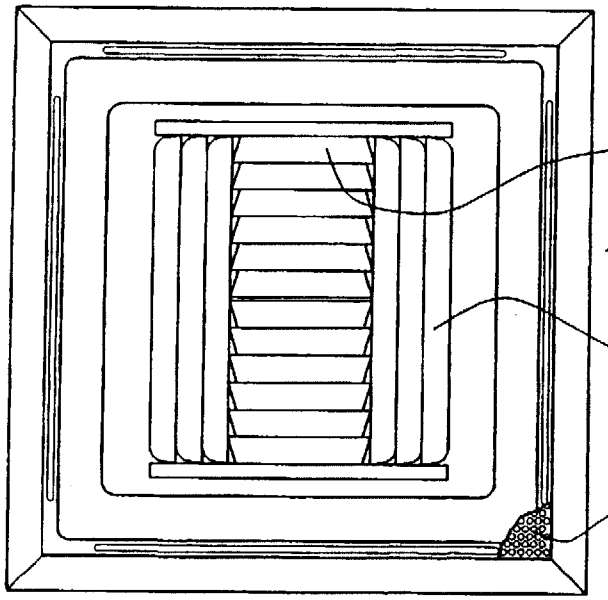
Fig. 1 PRIOR ART
FIG. 1 is a plan view of a conventional induction diffuser.
Figure 2:
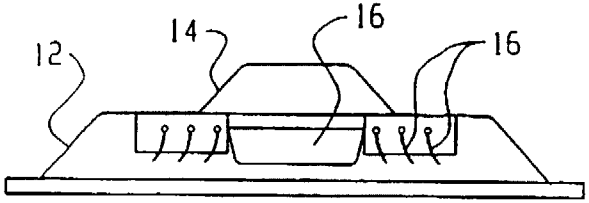
Fig. 2 PRIOR ART
FIG. 2 is a partial cross-sectional side view of the induction diffuser of FIG. 1.
Figure 3:
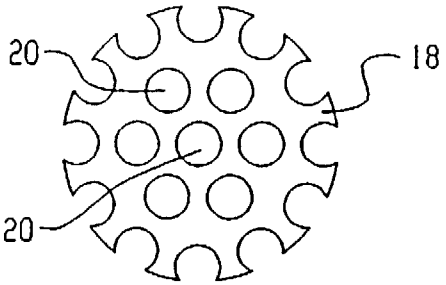
Fig. 3 PRIOR ART
FIG. 3 is a detail view of the perforated plate used on the induction diffuser of FIG. 1.

As will be discussed in greater detail hereinafter, the invention contemplates the use of fabric faces to improve air devices by reducing the visibility of the core of the air device improving the ability of the air device to blend with the ceiling or wall, reducing the shipping weight of the device, reducing structural loading caused by the device, reducing sound generated and transmitted by the device, creating a more balanced generated sound profile, reducing pressure drop through the device, increasing the reflectance of light incident on the device, simplifying cleanability of the device face, eliminating the need for pigmented paints to inhibit corrosion of the face, eliminating the possibility of corrosion to the device face, eliminating visible damage to the device or device face from chipped or scratched paint, increasing the strength of the device face and reducing sag in the face of the device. While use of fabric in air discharging devices has been known, it has been to facilitate laminar air flow. Laminar air flow is air discharging straight from the diffuser. For example, if the diffuser is mounted in the ceiling, the air is discharged straight down toward the floor. As will be discussed hereinafter, many air flow devices are not intended for laminar air flow, but attempt to create a discharge pattern with the air flow exiting the device being attached to the wall or ceiling using the Coanda effect. In the industry, these types of devices are referred to as diffusers, as contrasted with laminar flow devices. Laminar flow devices do not use the Coanda effect in operation.

A conventional induction diffuser 10 is illustrated in FIGS. 1–4. The induction diffuser is constructed of a body including a diffuser back pan 12 with neck 14, deflecting blades 16, and an optional diffuser face 18 mounted to the diffuser back pan. The face 18 has a series of holes 20 formed therethrough which comprise a certain selected percentage of the area of the face. Induction diffusers are mounted in ceilings by suspending the frame from a T bar ceiling grid, or by mounting the frame to the exposed surface of a hard plaster ceiling. Induction diffusers typically are designed so that the face of the diffuser is flush with the ceiling, but, alternatively can be made available with the face that drops a fraction of an inch below the plane of the ceiling T's. The diffuser is typically finished by painting in a variety of paint colors which serve to match the diffuser with the paint scheme specified by the architects. The painting also prevents rusting of the steel components. This paint, however, may chip or otherwise become damaged as a result of shipping and handling.

Figure 4:
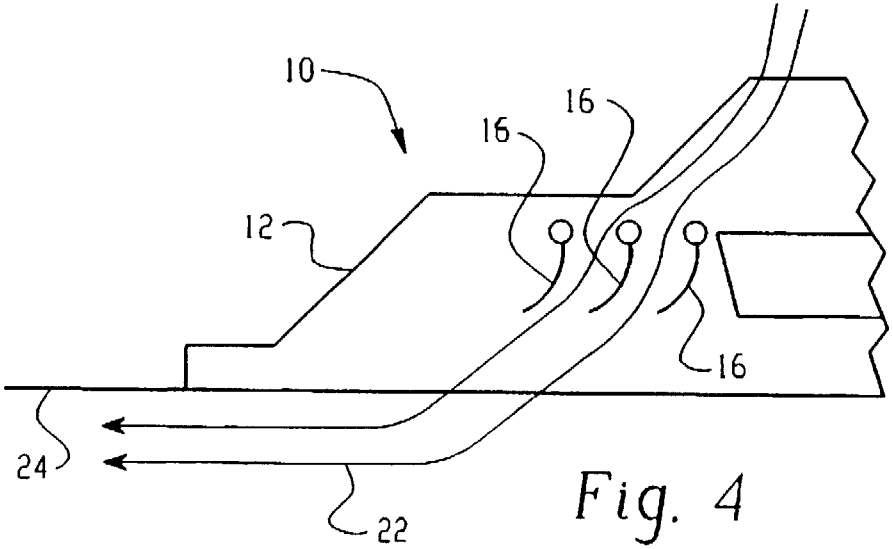
Fig. 4 PRIOR ART
FIG. 4 is a illustrative view of the air flow from the induction diffuser of FIG. 1.
Figure 5:
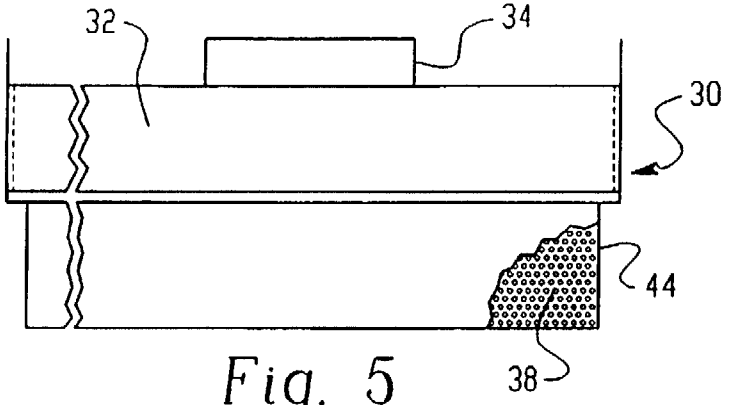
Fig. 5 PRIOR ART
FIG. 5 is a side view of a conventional radial flow diffuser.
Figure 6:
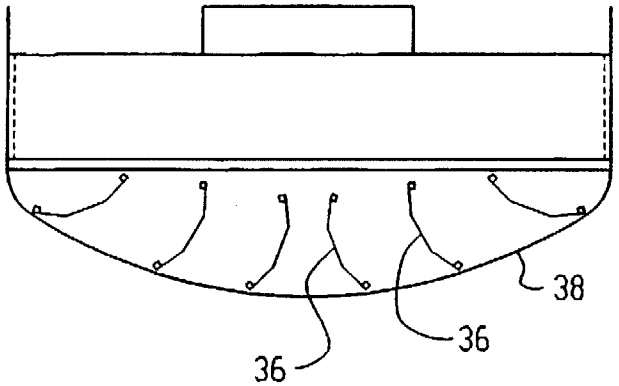
Fig. 6 PRIOR ART
FIG. 6 is a vertical cross-sectional view of the radial flow diffuser of FIG. 5.
Figure 7:
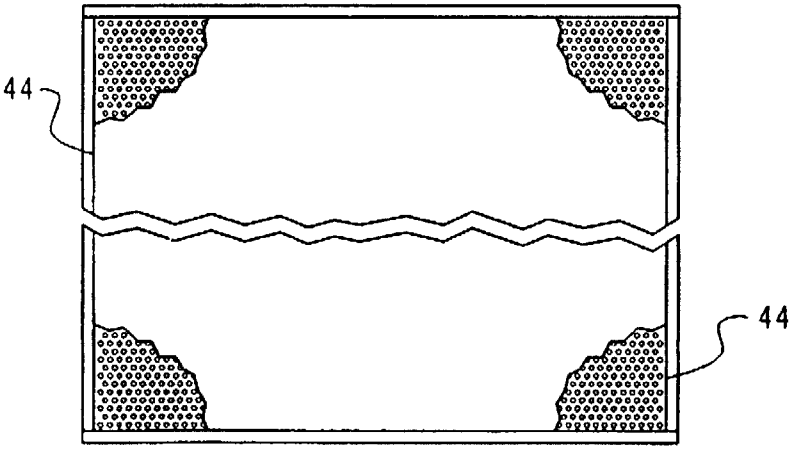
Fig. 7 PRIOR ART
FIG. 7 is a plan view of the radial flow diffuser of FIG. 5.

The function of the induction diffuser 10 is to control the flow 22 of conditioned air passed in a passageway or duct through the body from the neck 14 of the diffuser, through the back pan 12, over the deflector blades 16, and out through the face 18 at an acute angle relative to the ceiling plane 24 as best seen in FIG. 4. Maximum performance is achieved when the acute angle is such that air flows from the face of the diffuser, adhering to the ceiling through the phenomena known as a Coanda effect. The air flow angle is achieved by adjusting the deflector blades 16 and by optimizing the perforated or expanded metal holes 20 in pattern and size. Air volume control is achieved by means of a damper, typically mounted at the neck 14 of the diffuser, but sometimes mounted upstream of the diffuser in the duct work. Induction diffusers commonly have no diffuser face 18 to mask the core and back pan. However, the metal diffuser face 18 can be used to mask the elements. Typical perforated diffusers used with induction diffusers have an open area of 51% or greater. This open area describes the ratio of area through which air can travel to that area which is solid metal. Reduction in the percent of open area degrades the Coanda effect, while increasing the open area increases the Coanda effect. With a 51% open area, the building occupant can look up and see 51% of the core of the diffuser formed by the back pan and deflectors through the face, which is objectionable to some building owners and occupants. Clearly, the diffuser face 18 must be formed of sufficiently strong metal to support its own weight, otherwise the face could sag. When such a diffuser has a diffuser face 18, face 18 must be attached to the unit so that the plane of the face is roughly parallel to the plane of the ceiling. The attachment mechanism must also permit removal of the face to allow of convenient access to the diffuser core and optional damper.

The induction diffuser 10 can be used as a return air flow device as illustrated. However, return air devices of this type typically eliminate the use of the deflector blades as they are no longer required. The function of the return device is to allow air to pass from the conditioned space, through the face 18, back pan 12 and into the neck 14 through a return duct or open ceiling plenum. Designers often select returns to match the appearance of the supply diffuser, requiring device manufacturers to take steps to match the appearance.

Figure 8:
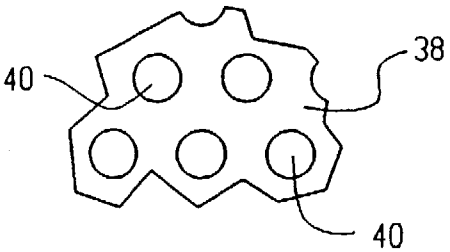
Fig. 8 PRIOR ART
FIG. 8 is a detail view of the perforated plate used on the radial flow diffuser of FIG. 5.

With reference now to FIGS. 5–9, a forced displacement radial flow diffuser 30 is illustrated. The radial diffuser is constructed with a diffuser back pan 32 with neck 34, a series of baffles 36 and a diffuser face 38. As seen in FIG. 8, the diffuser face 38 is formed with a series of holes 40 that occupy a selected percentage of the total area of the diffuser face. The diffuser face 38 is constructed of perforated aluminum or steel plate. The radial flow diffuser 30 is mounted in a ceiling by suspending the back pan from a T bar ceiling grid or mounting to the exposed surface of a hard plaster ceiling. Radial flow diffusers 30 are effective because they are shaped to direct air flow radially away from the diffuser. In order for this to occur, the face of the diffuser must protrude several inches below the plane of the ceiling 46. To prevent corrosion, the diffuser face is typically constructed of either aluminum or stainless steel. Paint is optional and is provided primarily for aesthetic purposes.

Figure 9:
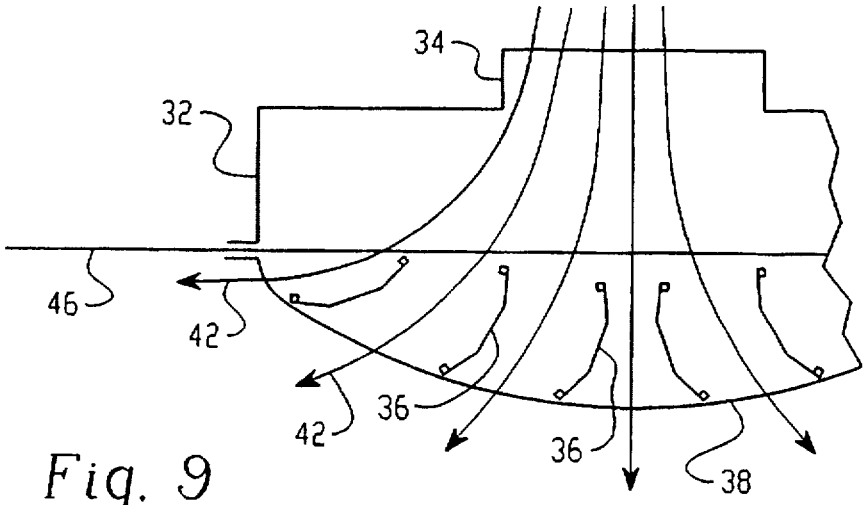
Fig. 9 PRIOR ART
FIG. 9 is an illustrative view of the air flow from the radial flow diffuser of FIG. 5.

The function of the radial flow diffuser 30 is to control the flow 42 of air passing from the neck 34 of the diffuser, through the back pan 32, over the baffles 36 and then out through the diffuser face 38, as shown in FIG. 9. A portion of the emitted air flow 42 adheres to the ceiling 46 through the Coanda effect. An additional function of radial flow diffusers is to minimize the induction of air from the air conditioned space back in to the stream of air emanated from the diffuser face. These radial flow diffusers maximize performance by protruding downward from the face of the ceiling 46, as described above. Solid end caps 44 at the edges of the diffuser face 38 support the face, baffles 36 and provide a critical shape for proper Coanda effect discharge. The face of the radial diffuser is either welded or riveted to the end caps 44. Air volume control is achieved by a damper, typically mounted at the inlet of the diffuser, but sometimes mounted upstream of the diffuser in the duct work.

Forced displacement radial flow diffusers typically have an open area of 13%. This relatively narrow hole opening assists in the development of pressure in the diffuser which evenly distributes air across the face.

Figure 10:
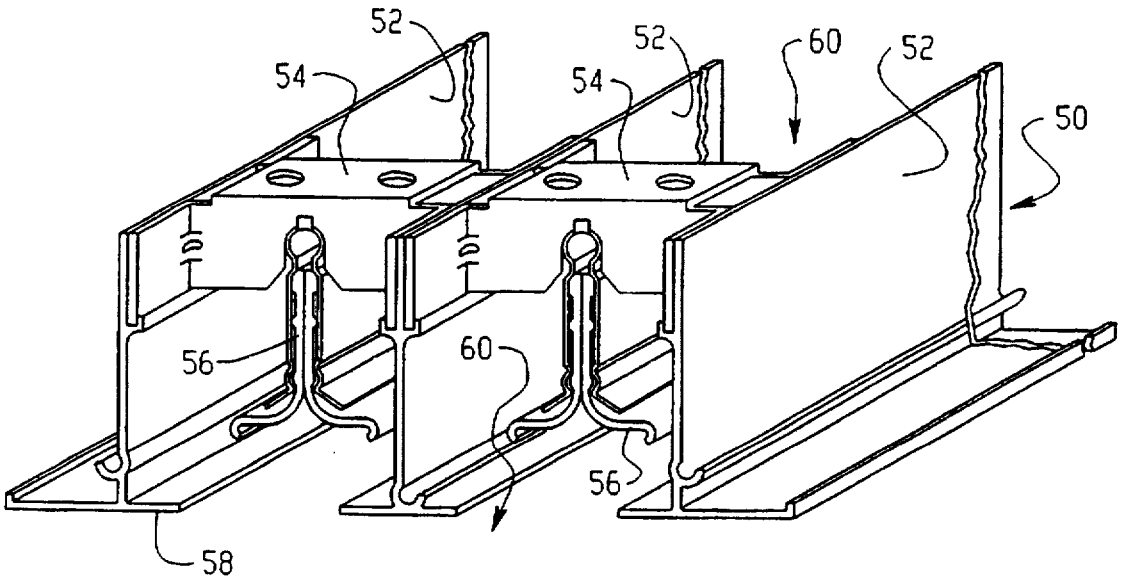
Fig. 10 PRIOR ART
FIG. 10 is a perspective view of a conventional linear diffuser.
Figure 11:
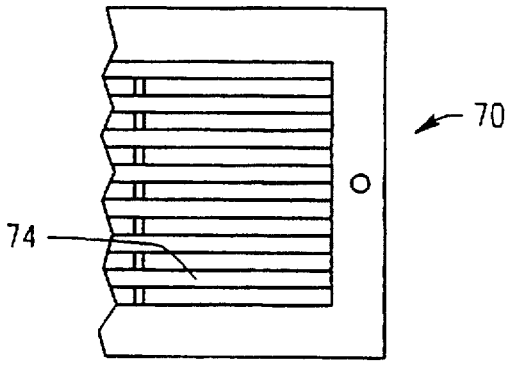
Fig. 11 PRIOR ART
FIG. 11 is a plan view of conventional supply grille.
Figure 13:
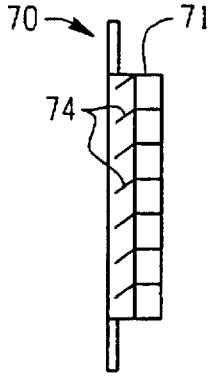
Fig. 13 PRIOR ART
FIG. 13 is a cross-sectional end view of the supply grille of FIG. 11.
Figure 12:
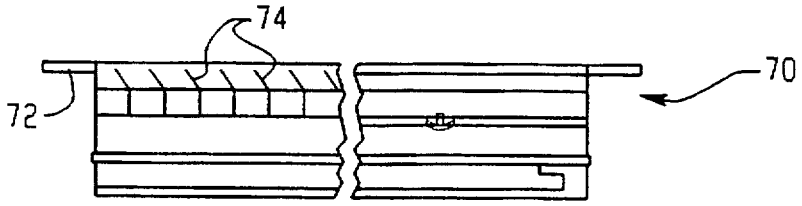
Fig. 12 PRIOR ART
FIG. 12 is a cross-sectional side view of the supply grille of FIG. 11.
Figure 14:
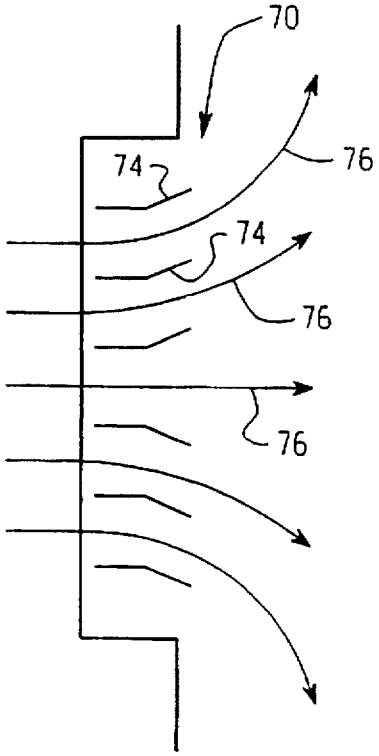
Fig. 14 PRIOR ART
FIG. 14 is an illustrative view of the air flow from the supply grille.
Figure 17:
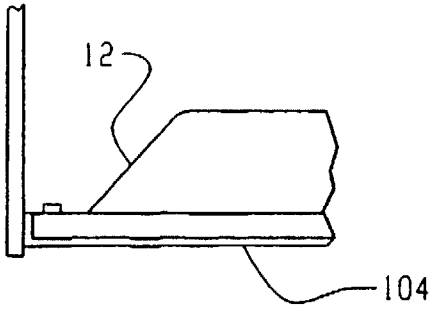
FIG. 17 is a detail view of the mounting of the induction diffuser of FIG. 15.
Figure 18:
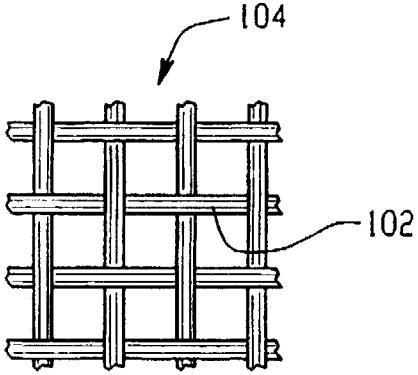
FIG. 18 is a detail view of the fabric covering the induction diffuser of FIG. 15.
Figure 15:
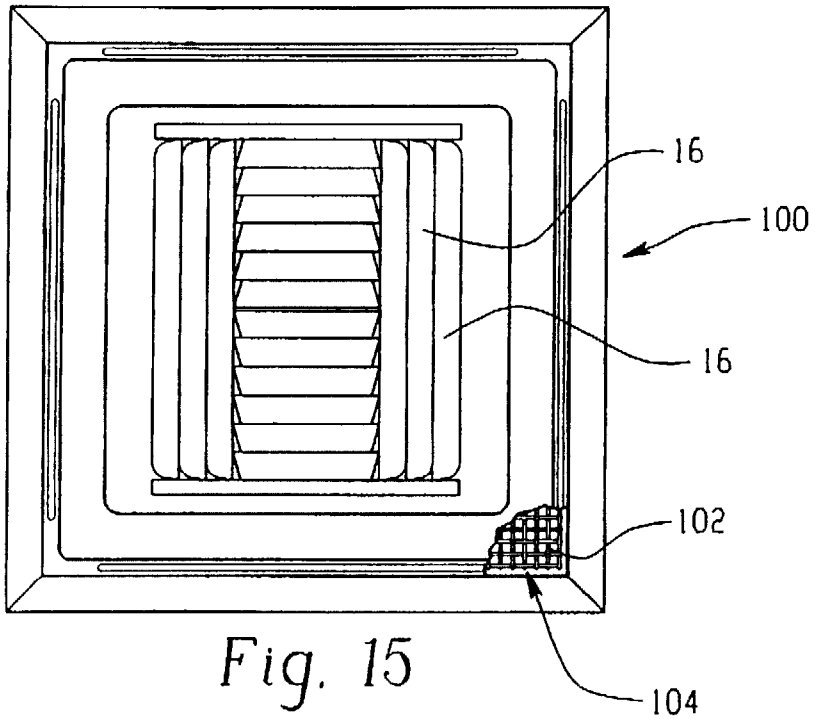
FIG. 15 is a plan view of an induction diffuser forming a first embodiment of the present invention.
Figure 16:
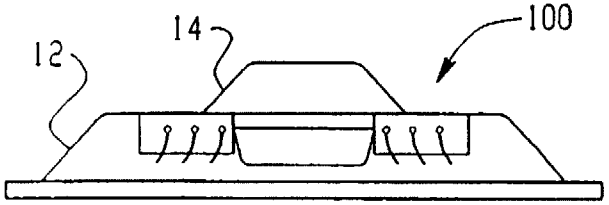
FIG. 16 is a cross-sectional side view of the induction diffuser of FIG. 15.
Figure 19:
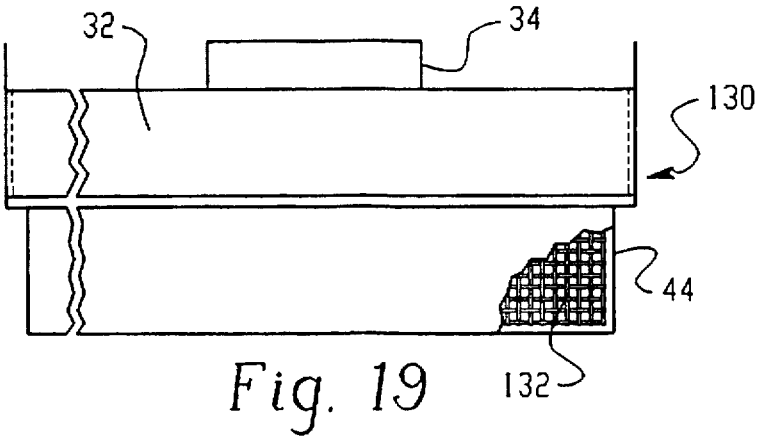
FIG. 19 is a side view of a radial flow diffuser forming a second embodiment of the present invention.
Figure 20:
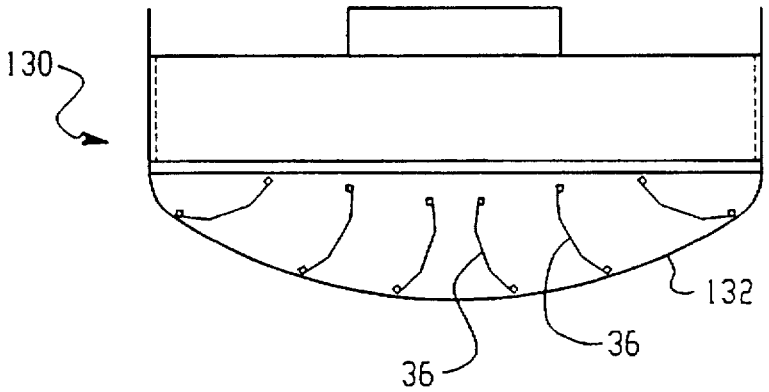
FIG. 20 is a vertical cross-sectional view of the radial flow diffuser of FIG. 19.
Figure 21:
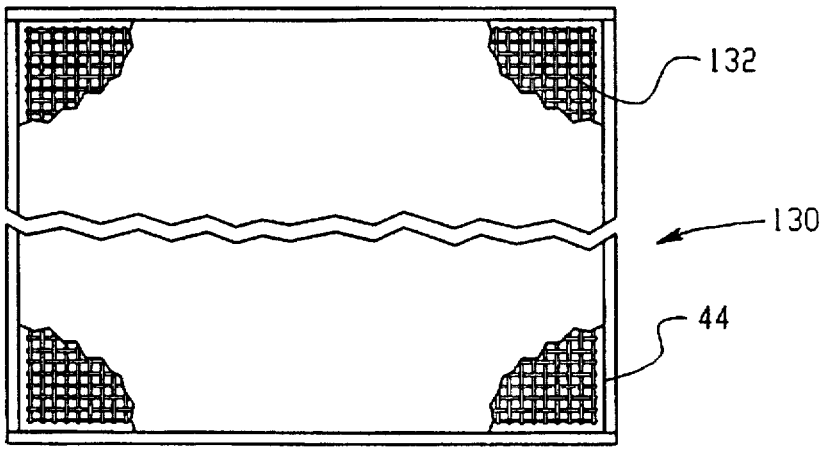
FIG. 21 is a plan view of the radial flow diffuser of FIG. 19.
Figure 22:
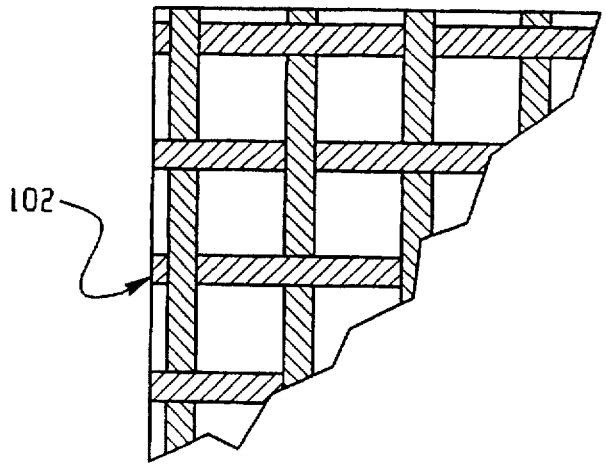
FIG. 22 is a detail view of the fabric on the radial flow diffuser.

With reference to FIG. 10, a conventional linear diffuser 50 is illustrated. Linear diffuser 50 has extruded aluminum frames 52 separated by spacers 54 which support extruded aluminum deflectors 56. Linear diffuser 50 is also mounted in a ceiling by suspending the diffuser from a T bar ceiling grid, or by mounting the diffuser to the exposed surface of a hard plaster ceiling or wall. Linear diffuser 50 is designed so that the face 58 of the diffuser is flush or nearly flush with the ceiling. The linear diffuser is finished by painting or anodizing the face 58 in a range of colors to match the diffuser with the color scheme specified by the architect, which is a key selling feature of linear diffusers. The function of linear diffuser 50 is to control the flow of air 60 passing from the neck of the device, between the frames 52 and across the deflectors 56. The deflectors 56 are adjustable to control the direction and volume of air flow. The deflectors can be adjusted to direct the flow of air along the ceiling, making use of the Coanda effect. The linear diffuser 50 can also be used as a return air device. When used as a return air device, the deflectors 56 are not needed and can be eliminated. The function of the return device is to allow air to pass from the conditioned space through the frame pieces and then out through the neck to a return duct or open plenum. Designers often select returns to match the appearance of the outlet, requiring device manufacturers to take steps to match the appearance.

With reference now to FIGS. 11–14, a conventional supply grille 70 is illustrated. The supply grille 70 has a neck 71 and a frame 72. Frame 72 also supports a series of deflecting blades 74. Typically, the frame and blades will be made of steel or aluminum. The blades 74 can be mounted in the frame 72 in a fixed manner or in an adjustable manner for adjustable air flow control. Supply grille 70 is mounted to a ceiling or wall by mounting the frame thereto. Supply grille 70 is typically finished by painting with a color which matches the grille with the paint scheme specified by the architect. Air volume control is usually achieved by means of a damper, typically mounted in the neck 71 of the supply grille, but sometimes mounted upstream of the grille in the duct work. The supply grille allows air 76 to pass through the blades, which deflects the air in a desired direction, then out into the air conditioned space. Perforated steel or aluminum faces are occasionally mounted on supply grills, which usually have a 51% free area. If no face is used, the blades of the grille are plainly visible. The supply grille 70 can also be used as a return air device. Typically, the deflecting blades 74 are used, even in a return air device, for appearance.

With reference now to FIGS. 15–18 and 30, an induction diffuser 100 forming a first embodiment of the present invention is illustrated. A number of the components of diffuser 100 are identical to diffuser 10 and are identified by the same reference numeral. However, induction diffuser 100 employs a fabric 102 to define the diffuser face 104 thereof which is attached to the back pan 12 to entirely cover the exposed portions of the induction diffuser 100. Preferably, the fabric 102 is woven fiberglass or Kevlar. Also, the fabric preferably includes a teflon coating. Kevlar is a trademark of Dupont Co. for its aramid carbon composite. Specifically, such a fiberglass fabric can be obtained from Chemfab Corporation of Merrimack N.H. known as Chemglas® style 1589 fabric. Suitable Kevlar material can be obtained from Chemfab Corporation as its TCK® style 1589 fabric. However, the fabric 102 can include any woven material. The same fabric is preferably used on all the induction diffusers 100 within the conditioned space, or even within the same offices or building. The use of the fabric provides a number of advantages as noted above. A preferred embodiment with a 10% open area fabric weighs only 0.09 pounds per square foot, compared with steel or aluminum diffuser faces, which weigh, for example, 0.62 pounds per square foot.

Illumination levels in a room are dependent on the reflectivity and color of the ceiling and walls. Ceilings and paints typically reflect 60% to 80% of incident light. Air outlets typically comprise up to five percent of a ceiling. Since the face of the typical conventional perforated diffuser is open 51%, 51% of the incident light travels into the core of the diffuser. The remaining 49% reflects off the painted surface of the diffuser face, at the stated 60% to 80% reflectance. The resulting overall reflectance for a perforated diffuser face is then 30% to 40%. Thus, 60% to 70% of the light shining on a perforated diffuser is absorbed by the diffuser, creating a dark, shadow effect in the ceiling or on the wall. In the preferred embodiment with 10% open area, the induction diffuser 100 has a reflectance of 70%, a vast improvement over currently available devices.

Sound emanates from an air supply or return device from two sources. The first is self-generated sound, and the second is air system sound. Self-generated sound is created by the conversion of air stream energy, in the form of pressure, into sound as it flows through the device. System sound is air generated by air system devices upstream of the air device. The system sound travels through the duct work, through the device and into the air conditioned space. Air devices typically generate sound as a result of air expanding, contracting and turning as it travels through the air device. Current diffusers typically have no ability to attenuate system sound. The use of the fabric 102 on the face 104 of induction diffuser 100 provides a sound damper to reduce the levels of both self-generated sound and system sound.

Conventional induction diffusers are cleanable by removing the diffuser and cleaning it with water or steam emitted from a high pressure hose. The difficulty exists in removing dirt and debris from the sharp-edged holes in perforated diffuser faces 18 as described above. In contrast, the fabric 102, particularly if coated with teflon, is difficult for contaminants to adhere to and those contaminants that do adhere to the fabric are easily removed by vacuuming or other similar operation.

The conventional induction diffuser 10 has a good low flame spread and smoke development rating in the event of fire. Fabric 102, particularly if coated with teflon, also can have an equally good low flame spread and smoke developed rating.

Figure 28:
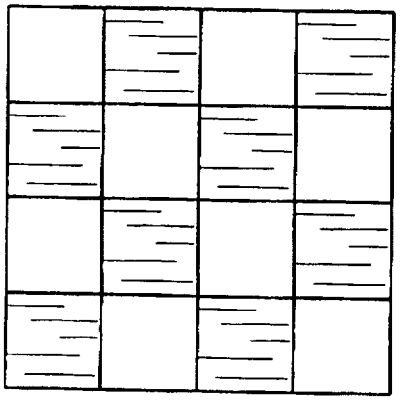
FIG. 28 is an illustration of a 50% open area fabric.
Figure 29:
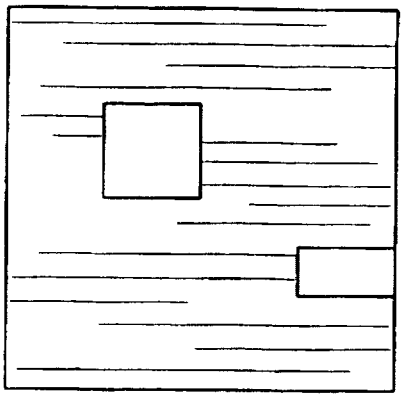
FIG. 29 is an illustrative view of a 10% open fabric.

FIGS. 28 and 29 illustrate fabric 102 with 50% open area and 10% open area, respectively. This illustrates the flexibility that is present by use of fabric 102. It also demonstrates how well the fabric masks anything behind it, relative to the 50% open area perforated metal.

The fabric 102 is not the only element of induction diffuser 100 which can be formed with a fabric base. Alternatively, any combination of the neck 14, back pan 12 and deflecting vane 16 can be constructed of fabric 102 which may be formed or otherwise made rigid to suit the needs of the installation. Thus, the induction diffuser 100 can either use a fabric 102 as a face of the diffuser, or make any combination of the other components in the diffuser of fabric. Further, it has been found that a diffuser can be made using this fabric which does not require use of deflecting vanes 16 while still allowing air to diffuse along the ceiling through the Coanda effect.

The fabric face 104 can be flush with, or may drop below, the plane of the ceiling as is the case with the conventional induction diffuser. When the fabric is coated with teflon, the bright, white finish of the fabric requires no painting operation. With no paint, there is no chance of the paint becoming damaged, nor can the fabric rust, as can occur with induction diffuser 10. Preferably, the non-fabric components of the induction diffuser 100 are painted black to maximize the masking effect of the fabric 102. The fabric 102 can also be pigmented to match a color specified by the end user. Even if pigmented, the color will be more durable and easier to clean than the face of induction diffuser 10.

While the open area of the fabric face 104 is preferably 10%, the range of effective open areas is believed to be between about 5% and 25%. In spite of expectations that the fabric might Laminerize the flow, it has been shown that air will flow through the fabric 102 at an acute angle relative to the ceiling, allowing the induction diffuser 100 to use the Coanda effect in the same manner as the induction diffuser 10.

The induction diffuser 100, when installed, provides an appearance to an observer with use of the fabric 102 with 10% open area that blocks the view of components 80% better than the induction diffuser 10 having face 18. The induction diffuser blocks the view of components 90% better than diffuser 10 when not using a face 18. Of course, the reduction in visibility of the internal components of induction diffuser 100 can be altered by varying the open area of the fabric 102.

The pattern of air leaving a diffuser is defined by the parameters throw and spread. Throw is a measure of the distance the emitted air travels across the room. Spread describes the area over which the emitted air covers. Induction diffusers have varying throw and spread, depending on the type of diffuser, and the form of the elements comprising the diffuser. The throw of the induction diffuser 100 in the preferred embodiment, with 10% open area, is less than that for a induction diffuser 10. However, the spread is greater.

The induction diffuser 100 can be used as a return air device as illustrated. The deflecting vanes 16 can be removed or not installed as desired when used as a return air device.

Figure 30:
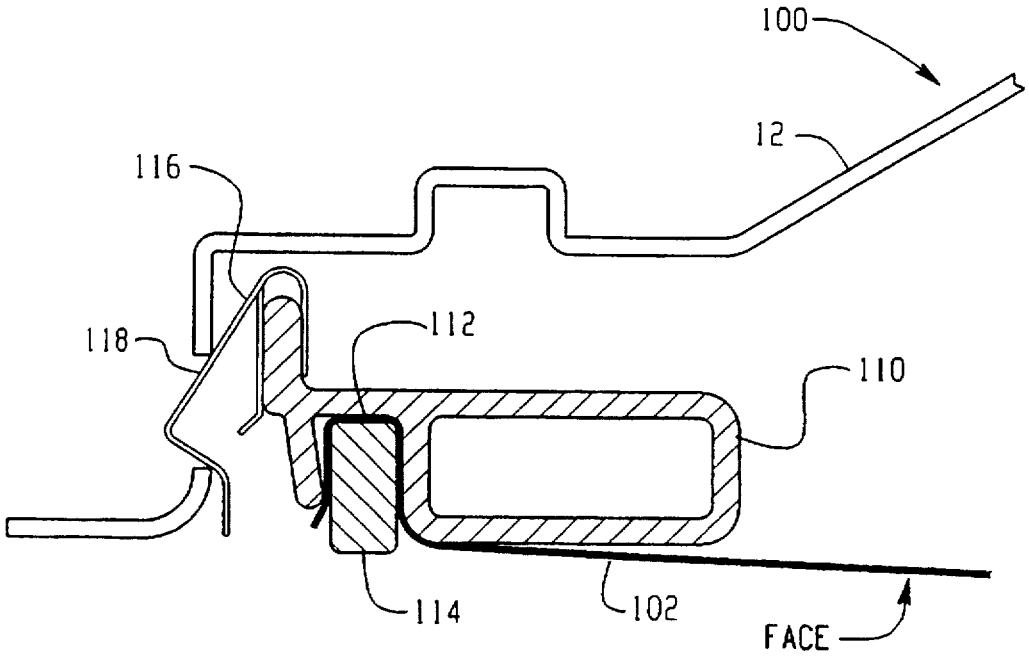
FIG. 30 is an illustrative view of the attachment of a fabric face.

With reference to FIG. 30, one technique for mounting fabric 102 on diffuser 100 is illustrated. A frame 110 formed of an extrusion is provided which fits about the periphery of the diffuser 100 so as to avoid interference with the air flow. The frame has a recess 112 to receive a tension bar 114. A series of retainer clips 116 fit over a portion of the frame 110 and snap into holes 118 formed in the back pan 12 to secure the frame to the back pan. The fabric 102 is threaded about the tension bar 114 and into recess 112 as shown, which holds the fabric 102 to frame 110 under tension. The clips 116 allow the frame 110 and fabric 102 to be removed from the back pan 12 for cleaning or adjustment of the deflecting blades 16 or damper.

With reference now to FIGS. 19–22, a radial flow diffuser 130 forming a second embodiment of the present invention is illustrated. Many elements of radial flow diffuser 130 are identical to elements in radial flow diffuser 30, and identified by the same reference numerals. However, the radial flow diffuser 130 is constructed with a fabric diffuser face 132 stretched over the solid end caps 44. The fabric 132 can be of the same type as fabric 102. Preferably, the fabric has a percent open area ranging from 1% to 20%. The open area can also be expressed by the porosity and permeability. For example, an effective range of porosity and permeability is 5 to 40 scfm per foot squared at 0.5 inch water gauge pressure drop.

The radial flow diffuser 130 using the fabric diffuser face 132 will have all the advantages noted previously for induction diffuser 100, including a reduction in noise level, an increase in reflectivity, a neater appearance and easy cleanability.

If desired, the end caps 44 can also be formed of fabric. The fabric face 132 can be fused to the end pieces and maintain its shape through gravity and air pressure in the diffuser 130. In addition, any combination of the neck 34, back pan 32, baffles 36 or other components of the radial flow diffuser can be constructed of fabric as well. The forced displacement radial air diffuser flow is not adequately characterized by throw and spread, which are two dimensional in nature. Rather, the radial flow diffusers are best characterized by the shape of the three-dimensional envelope of air emitted from the diffuser. This shape is not described by a single parameter, but rather, can be determined by experimental or mathematical modeling. The function of radial flow diffuser 130 in discharging air is identical to radial flow diffuser 30. If the end caps 44 are made porous, additional air will clearly flow through the end caps as well, altering and improving the conventional distribution of the radial flow diffuser.

Figure 23:
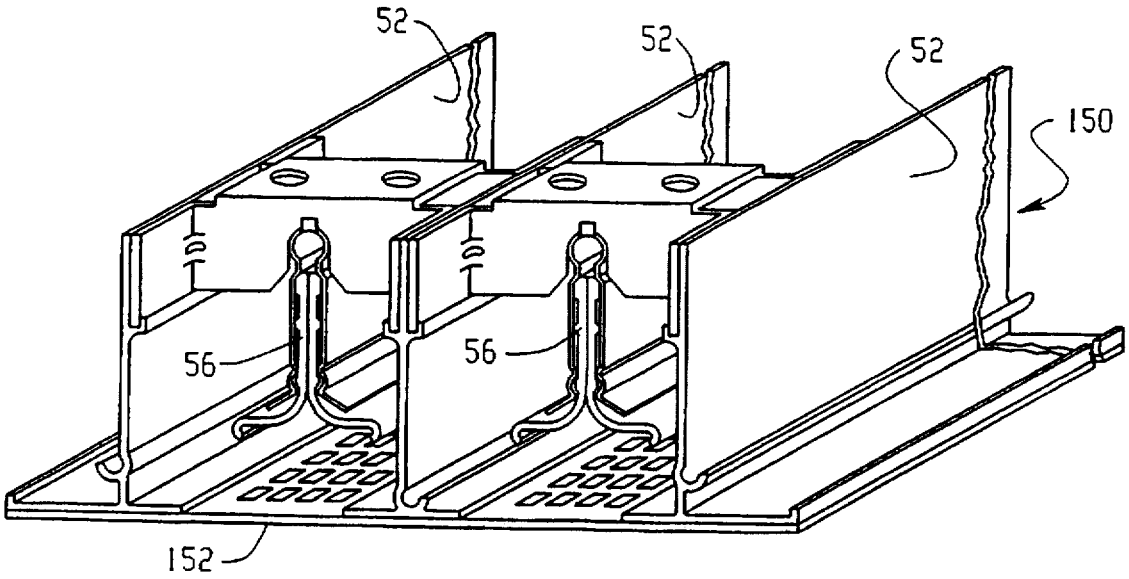
FIG. 23 is a perspective view of a linear diffuser forming a third embodiment of the present invention.
Figure 24:
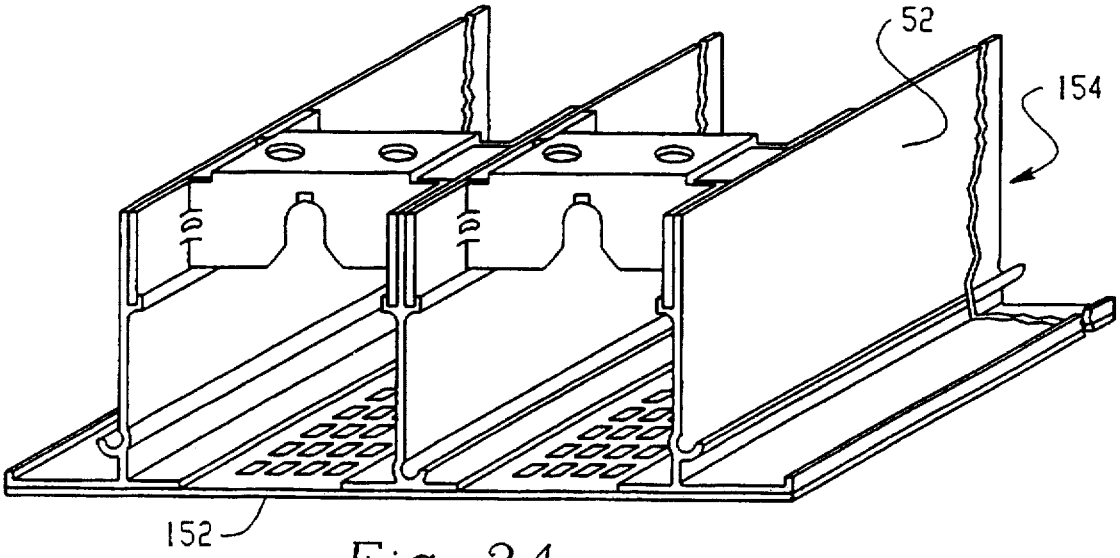
FIG. 24 is a perspective view of a linear return.

With reference now to FIGS. 23 and 24, linear diffuser 150 is illustrated which forms a third embodiment of the present invention. Many elements of linear diffuser 150 are identical to those of linear diffuser 50 and are identified by the same reference numeral. However, in linear diffuser 150, a fabric face 152 covers the exposed portions of the diffuser 150. Fabric face 152 can be formed of the same material as fabric 102. The fabric face 152 masks the frames 52 and deflectors 56 of the installed diffuser from the vision of an observer. Alternatively, the frames 52 or deflectors 56, themselves, can be constructed of formed or shaped fabric. Again, the use of the fabric face 152 provides the advantages described above. In the preferred embodiment, the fabric is coated with teflon which provides a bright white finish requiring no painting operation. As such, there is no chance of a face paint becoming damaged. Preferably, the frames 52 and deflectors 56 are painted black to maximize the masking effect of the fabric face 152. Also, the fabric face 152 can be pigmented to match a color specified by the end user.

FIG. 24 illustrates a linear return diffuser 154 which employs fabric face 152 and deletes the deflectors 56.

Figure 25:
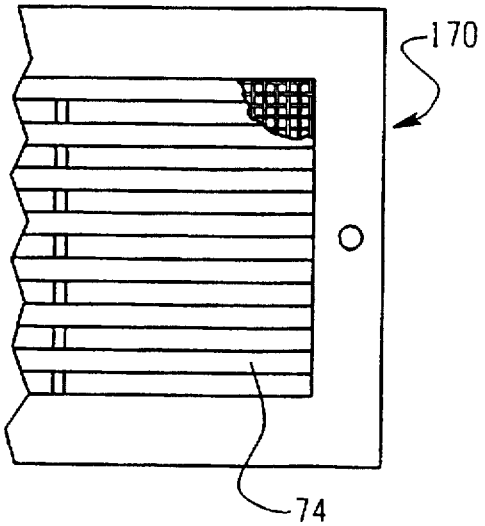
FIG. 25 is a plan view of a supply grille forming a fourth embodiment of the present invention.
Figure 26:
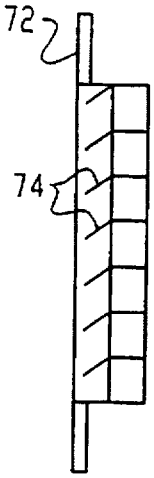
FIG. 26 is a cross-sectional end view of the supply grille of FIG. 25.
Figure 27:
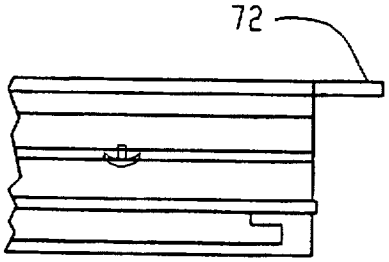
FIG. 27 is a cross-sectional side view of the supply grille of FIG. 25.

With reference now to FIGS. 25–27, a supply grille 170 forming a fourth embodiment of the present invention as illustrated. The supply grille 170 contains many components identical to supply grille 70 and are identified by the same reference numerals. However, the supply grille 170 has a fabric face 172 covering the exposed portions of the supply grille 170. Fabric face 170 can be formed of the same material as fabric 102. The fabric face masks the frame 72 and deflecting blades 74 of the supply grille 170. Again, the frame 72 and deflecting blades 74 can also be constructed of formed or shaped fabric, and used with or without a fabric face 172. The fabric is preferably teflon coated, which will provide a bright, white finish to the fabric face requiring no painting operation. The frame 72 and deflecting blades 74 can be painted black to maximize the masking effect of the fabric face. In addition, the fabric face 172 may be pigmented to match a color specified by the end user. The supply grille 170 can be used as a return air device as well.

In testing of the devices described above, sound generation using a fabric face as disclosed will generally be 5 to 7 NC lower than the equivalent conventional air flow device. The NC curve is also flatter, and, more pleasing to the observer as it more resembles white noise. The pressure drop through the fabric face is essentially equivalent to that of the conventional air devices, despite a significant reduction in open area.

Although several embodiments of the invention have been illustrated in accompanying drawings and described in the foregoing detailed description, it will be understood that the invention is not limited to the embodiments disclosed, but is capable of numerous rearrangements, modifications and substitutions of parts and elements without departing from the spirit and scope of the invention.

We claim:

1. An air circulation device for conditioning a room, comprising a body defining a passageway for flow of air, the passageway having an opening into the room, deflectors mounted in the passageway for directing air flow in a predetermined diffuse pattern through the passageway opening and a fabric covering the passageway opening and being positioned downstream of the deflectors to allow the directed air flow to pass therethrough and into the room in that diffuse air flow pattern.

2. The air circulation device of claim 1 wherein the fabric has an open area of less than 25%.

3. The air circulation device of claim 2 wherein the fabric is comprised of fiberglass or an aramid carbon composite material, with both having a teflon coating.

4. An air circulation device for conditioning a room, comprising:

a body defining a passageway for flow of air, the passageway having an opening into the room, a fabric covering the passageway opening comprised of fiberglass or aramid carbon composite material with a teflon coating, the opening area of the fabric being approximately 1–25%.

5. The air circulation device of claim 4 wherein the fabric is stretched across a frame, which is releasably mounted to the body.

* * * * *